US005733492A

United States Patent [19]

Appeldoorn et al.

[11] Patent Number: 5,733,492

[45] Date of Patent: Mar. 31, 1998

[54] SPINNERET OF GOLD AND PLATINUM-CONTAINING ALLOY

[75] Inventors: Jacques Wilhelmus Jozef Appeldoorn, Doornenburg; Paulus Christiaan Maria Gortemaker, Arnhem, both of Netherlands

[73] Assignee: Akzo Nobel N.V., Arnhem, Netherlands

[21] Appl. No.: 682,775

[22] PCT Filed: Jan. 30, 1995

[86] PCT No.: PCT/EP95/00325

§ 371 Date: Jul. 30, 1996

§ 102(e) Date: Jul. 30, 1996

[87] PCT Pub. No.: WO95/20696

PCT Pub. Date: Aug. 3, 1995

[30] Foreign Application Priority Data

Jan. 31, 1994 [EP] European Pat. Off. ..... 94200215

[51] Int. Cl.[6] ..... D01D 4/00; D01D 5/08

[52] U.S. Cl. ..... 264/176.1; 425/463; 425/464

[58] Field of Search ..... 264/176.1; 425/463, 425/464

[56] References Cited

U.S. PATENT DOCUMENTS

| | | | |
|---|---|---|---|
| 1,980,234 | 11/1934 | Taylor | 425/464 |
| 4,155,730 | 5/1979 | Biberbach et al. | 65/493 |
| 4,839,113 | 6/1989 | Villaine et al. | 264/28 |
| 5,472,333 | 12/1995 | van der Zel | 425/464 |

FOREIGN PATENT DOCUMENTS

| | | |
|---|---|---|
| 168879 | 1/1986 | European Pat. Off. . |
| 598431 | 5/1994 | European Pat. Off. . |
| 2247553 | 5/1975 | France . |
| 863841 | 12/1952 | Germany . |
| 1957239 | 5/1971 | Germany . |
| 1475904 | 6/1977 | United Kingdom . |

OTHER PUBLICATIONS

Derwent Patent Abstract 92-205396/25 (1992).
Patent Abstracts of Japan, vol. 17, No. 79 (C-1027), 1993.
Derwent Patent Abstract 35541S-AF (1971).
W. Funk et al., "Spinndüsen-Bauteile für die Chemiefaser-industrie", Chemiefasern/Textilindustrie, Jun. 1972, pp. 518-522.
H. Schmid et al., "Zur Frage der Korngrösse und Aushärtung von Gold-Platin-Legierugen", Metallwissenschaft und Technik, 12, Jg, Jul. 1958, Heft 7, 612-619.

*Primary Examiner*—Leo B. Tentoni
*Attorney, Agent, or Firm*—Richard P. Fennelly; Louis A. Morris

[57] ABSTRACT

The invention relates to a spinneret of a very specific geometry which provides more strength compared with the commonly applied spinnerets, and to a spinneret made of a specific metal alloy which also provides a further high strength. In combination, a spinneret is resistant to spinning pressures up to 60.000 kPa if it is made of the specific geometry and made of the preferred metal alloy of gold, platinum, rhodium and palladium, which does not comprise contaminations and which material is very homogeneous and thus does not show an obvious second phase.

25 Claims, 2 Drawing Sheets

SPINNERET OF GOLD AND PLATINUM-CONTAINING ALLOY

BACKGROUND OF THE INVENTION

The invention relates to a spinneret of a gold and platinum-containing metal alloy with spinning orifices, the face provided with the spinning orifices being convex, and the spinneret being provided with a raised edge.

Such a spinneret is known. In W. Funk and R. Schumm, "Spinndüsen-Bauteile für die Chemiefaserindustrie," *Chemiefasern/Textilindustrie,* June 1972, 518–522, spinnerets to be used in wet spinning processes are disclosed. These spinnerets are made of metal alloys of gold, platinum, and rhodium. An alloy comprising 49 wt. % of Pt may be heat treated to a hardness of 330 Vickers, an alloy comprising up to 30 wt. % Pt to a hardness of 230 Vickers.

The thickness of the sheet material used fort the spinneret is in the range of 0.2 to 0.8 μm. In order to be able to withstand deformation at higher spinning pressure, the spinning face was made convex and a reinforcing ring was employed to give still greater strength. Yet in spite of these measures the spinneret will undergo permanent deformation at pressures in excess of about 600 kPa. Deformation of the spinning surface in turn results in a severe reduction of the quality of the fibres produced due to lack of uniformity in fineness, irregular shape, etc.

A spinneret has now been found which does not have the drawbacks indicated in the description of this article.

SUMMARY OF THE INVENTION

The invention relates to a spinneret of a gold and platinum-containing metal alloy, in which the face provided with spinning orifices is convex and the spinneret is provided with a raised edge and a gripping edge at which the spinneret can be gripped in a spinning assembly, the gripping edge being immediately adjacent to the face provided with spinning orifices.

DESCRIPTION OF THE PREFERRED EMBODIMENTS

Figure 1:
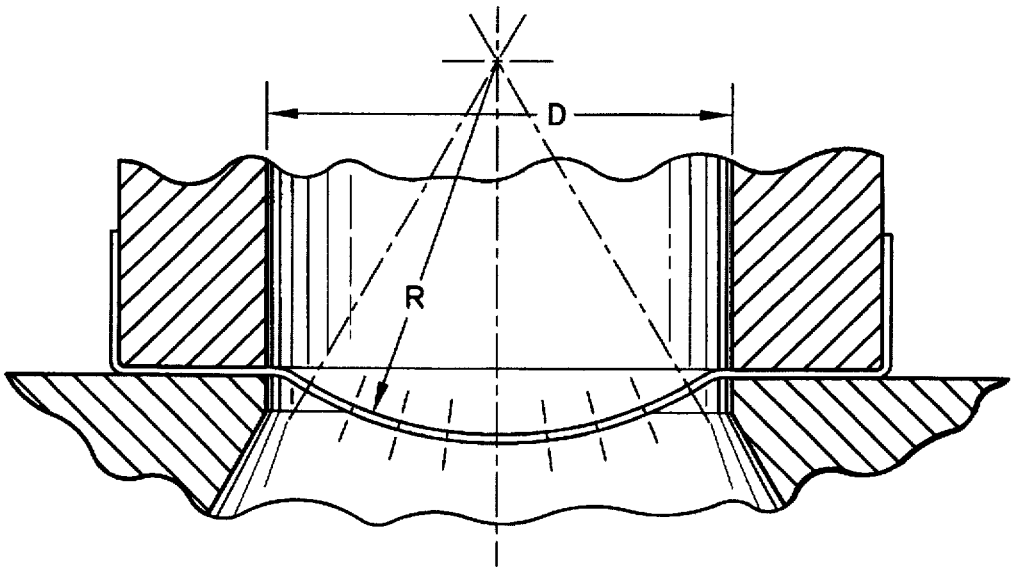
FIG. 1 is a schematic of a spinneret wherein the gripping edge is flat and at right angles to the direction of the polymer stream entering the spinneret.

The face provided with spinning orifices is convex, due to which the forces on the spinneret are distributed over the surface. A spinneret with such a spinning surface is described in JP-04-136207-A, this spinneret having a spherically protruding spinning surface.

It has been found that if the gripping surface of the spinneret is immediately adjacent to the spinning surface, the resistance of the spinneret to high forces is significantly higher than that of spinnerets of a geometry known from, inter alia, the above-cited article. Thus, the particular construction according to the present invention provides a spinneret having substantially greater strength than the known spinnerets, even though it has a very small thickness. Moreover, the strength of a spinneret having a raised edge on its outer side is higher than that of a spinneret without such a raised edge.

An additional advantage of the now found spinneret consists in that it allows the use of highly viscous solutions at high speeds, so that a major economic advantage is obtained.

In the case of the spinneret according to the present invention, the spinning surface can make one angle with the gripping edge or not. The gripping edge is usually a flat surface in which the spinneret is held fast. In that case, the bulged spinning surface will make an angle with the gripping edge. Alternatively, the outer part of the spinning surface by which the spinneret is held fast can be used as the gripping edge, the gripping edge thus being an extension of the spinning surface but not actually part of the spinning surface. In that case, the spinning surface does not make an angle with the gripping edge.

The spinning surface has a completely fluent shape, without any angles. Of course, if a flat gripping edge protrudes somewhat because the spinneret is gripped at a short distance from the angle between the gripping edge and the spinning surface, such a configuration is still within the scope of the invention.

The spinning surface is the convex surface found between the gripping edges, whether spinning holes are present across the entire surface or not. The spinning orifices may be grouped together or clustered together or be in some other kind of arrangement. Reference is made to EP 168 879.

The spinneret according to the invention can be round, oblong, oval, circular, or any other applicable shape. In the case of a round spinneret, the curvature preferably is spherically shaped. In the case of an oblong or circular spinneret, the spinning surface curvature preferably is fluently oblong or round in shape, respectively. For application in wet spinning processes circular spinnerets were found to be preferred.

The minimum radius of the curve of the spinning surface will be at least half the shortest distance between the adjacent gripping edges.

The distance between the gripping edges, hereinafter referred to as D, is less than two times the radius of the convex curve, hereinafter referred to as R. In a preferred embodiment, the distance between the gripping edges D is at least 0.05 times the radius R. Preferred are spinnerets of which the distance D is at least 0.5, 0.65, or at least 0.8 times the radius R, and less than 1.5 times the radius R in view of the improved strength obtained by use of a spinneret having a convex curve of such indicated bulging. A most applicable optimum is a spinneret of which D is about equal to R.

The gripping edge itself can be flat and at right angles to the direction of the polymer stream entering the spinneret, as is illustrated in FIG. 1. In that case, the angle between the raised edge and the gripping edge will usually be about 90°.

Figure 2:
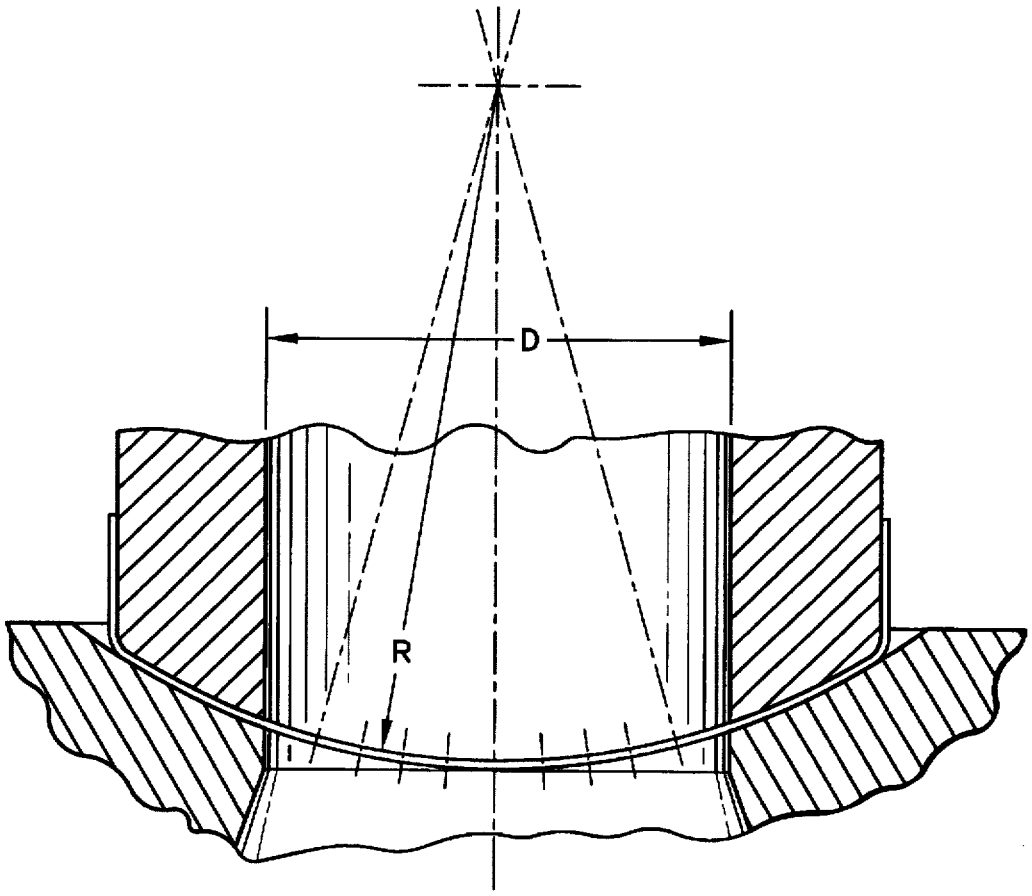
FIG. 2 is a schematic of a spinneret wherein the gripping edge is directly in line with the spinning surface.

It has been found that a further significant improvement of the strength of the spinneret is obtained if the spinneret has a gripping edge which is directly in line with the spinning surface, as is illustrated in FIG. 2. In that case, the gripping edge will be (slightly) curved. The angle with the raised edge is dependent on the curve of the spinning surface.

Spinnerets preferably have the highest possible strength in order to enable them to be used in processes with high spinning speeds or for the spinning of highly viscous materials. To this end, it is known that the sheet material should be as thick as possible. However, the thickness of the sheet material used for spinnerets is considered subject to restriction on two counts: for reasons of finance, as spinnerets are usually made of noble metal or a nobel metal alloy and increasing the quantity of such material per unit area surface will give a marked increase in price, and because it is not thought feasible to drill spinneret orifices of the dimensions needed, i.e., between 12 and 120 μm, in thicker sheet material. An even greater problem concerns the punching of holes in metal plates for the preparation of such spinnerets. Also, spinning highly viscous material is extremely difficult if the very narrow spinning channels are very long.

The spinneret of the present invention no longer needs to be made of the thickest possible sheet material in order to be able to withstand high spinning pressures. Hence, the disadvantages indicated above do not occur. The thickness of the spinneret according to the present invention will be in the range of 0.3 to 1.75 mm. In a preferred embodiment, it will be in the range of 0.5 to 1.5 mm, more particularly in the range of 0.8 to 1.3 mm. An optimal thickness in view of pressure resistance and ease of production is found if the thickness of the spinneret sheet is in the range of 0.9 to 1.2 mm. If the pressures on the spinneret are to be very high, i.e., more than 50 000 kPa, the spinneret preferably has a thickness of about 1 mm. The low sheet material thickness makes it possible to use a greatly simplified method of manufacturing compared with the known spinnerets, which derive their high strength from a much larger thickness.

The now found spinnerets are made of a noble metal alloy as, generally speaking, the use of such an alloy will give a strong spinneret and good corrosion resistance.

The noble metal alloys that are applicable according to the present invention contain gold and platinum. Also rhodium may be present in the noble metal alloys to be applied. In a highly preferred embodiment of the present invention, the noble metal alloy to be used is as pure and homogeneous as possible. This means that only very little or no contaminations or impurities are present in the metal alloy, i.e. less than 0.02 wt. % of any material not being one of the noble metals in the alloy. Preferably, less than 0.015 wt. % of contaminations are present in the alloy. Contrary to what is known and recommended in the field of spinnerets, e.g. in an article of Dr. Ing. Heinz Schmid, Zur Frage der Korngröße und Aushärtung von Gold-Platin-Legierungen", *Metallwissenschaft und Technik*, 12. Jg, July 1958, Heft 7, it was found that a further significant improvement is found if the material is as homogeneous as possible, which means that the material has a fine homogeneous structure in which no obvious second phase is present. The presence of such a second phase is to be determined by making an elemental map by use of Energy Dispersive X-ray analysis, also known as "EDX". The analysis conditions of the EDX are as follows: the analysis is carried out on the cross section, parallel to the direction of rolling, in the center of the plate to be analysed. The enlargement of the picture taken is 220 ×, elemental mapping takes place at a speed of scanning of 50 nsec/pixel. The X-ray take-off angle is 40°. Use is made of an Electrongun of the type EHT 20 kV, the Beaucurrent is 0.5 nA and the working distance 30 nm.

It was found that the improvement of physical properties of the spinneret can be further increased if the spinneret is made of a noble metal alloy which has a grain size which is as small as possible in addition to the pureness and homogeneity thereof. These material furthermore show an increased corrosion resistance, which is in particular beneficial for the use of the spinnerets in processes were acid containing spinning solutions are spun. Preferably, the grain size is less than 25 μm, and in particular less than 20 μm.

It was found that there is a marked improvement in strength when use is made of a noble metal alloy which in addition to gold, platinum, and rhodium contains palladium. In the German *Offenlegungsschrift* 2 703 801 also spinnerets of a noble metal alloy made up of these constituents are described. In this published document spinnerets are disclosed which contain a low percentage of gold and a comparatively high percentage of palladium. It has been found, however, that the use of alloys containing only a minute percentage of rhodium and a higher percentage of gold will result in a further significant improvement of the spinneret properties. Thus, alloys containing gold, platinum, rhodium, and palladium in a weight ratio of 50–65:20–40:0–8:5–15 were found to display a markedly improved strength when used in spinnerets. Preferably, the metal alloy employed comprises gold, platinum, rhodium and palladium in a weight ratio of 58–61:28–32:0–2:8–12. The best results are obtained if the material of which the spinneret is made consists of a metal alloy of gold, platinum, rhodium and palladium. A significant increase in physical properties such as strength and yield is found if the alloy used has a very homogeneous structure as indicated above.

It was found that even when a spinneret of conventional geometry of which the gripping edge was not adjacent to the spinning face was applied, there was a surprising increase in strength when applying the metal alloy indicated above.

Further improvement of the spinneret according to the invention was found in the application of the indicated noble metal alloy for the production of a spinneret of the geometry indicated in FIG. 2.

Spinnerets made of a noble metal as indicated in the claims show a good corrosion resistance. With spinnerets made of the noble metal alloys of the preferred embodiments not only a significant increase in strength is obtained, but also these preferred embodiments were found to display an enhanced corrosion resistance, which is an obvious advantage in the case of polymer solutions containing a strong acid. It was found that the corrosion resistance is further improved if the most preferred metal alloy indicated above is used, in particular if the grain size is less than 20 μm and no large grains are present in the material.

Furthermore, an improvement of the production method for the spinneret is obtained by use of the metal alloy of the preferred embodiment indicated before. It has been found that in the case of the spinneret according to the invention there is no longer any need to drill the spinneret orifices. By punching without drilling, very even capillaries are obtained, so that the geometry of the filaments formed via these capillaries is virtually identical and optimal. This in itself is known from the prior art, but it has not been possible up to now to obtain spinnerets of such strength as provided according to the present invention.

According to a very beneficial process for making the spinnerets of the present invention, the spinneret is manufactured by making a sheet of a homogeneous noble metal alloy of a thickness in the range of about 0.5 to 1.5 mm, cutting out the proper shape and giving the spinneret the desired form by use of a commonly known method suitable thereto, punching the required number of spinning orifices into the obtained shaped material, and finally curing the material by subjecting it to a heat treatment.

A satisfactory curing treatment was found in treatment of the spinnerets at a temperature of about 1323 to 1423 K (1050° to 1150° C.) over a period of 30 minutes, followed by rapid cooling in water, and a subsequent heat treatment of about 3 to 6 hours at a temperature of about 823 to 873 K (550° to 600° C.). Such a curing process is known in itself. The heat treatment of the spinning surface through which the spinning orifices have been made and Which has been formed into a spherical shape, as described above, makes it possible to remove any internal stress produced during the making of the spinning orifices and manufacture a spinneret having a spherical spinning surface with a uniform radius of curvature. Furthermore, the production of spinnerets as described makes for spinning orifices which have a very symmetrical shape. As a result, the use of such a spinneret provides very uniform and symmetrically shaped fibres and, thus, fibres of constant quality.

The spinning capillaries can be any number, but will usually range from 30–100 (e.g., in textile fibres spinning processes), up to 2 000 for technical yarns, and even up to 20 000 or more (e.g., in spinning processes for staple fibres making). The spinnerets of the present invention are also applicable in wet spinning processes. The orifices preferably have a cylindrical shape, but, if so desired, may also be of some other shape, e.g., star-shaped, lobe-shaped, etc. In a preferred embodiment, the capillaries have an inflow angle of about 5°–30°. Said inflow opening can have any shape and can be optimized depending on the polymer material to be spun from it. E.g., the capillary entrance can be hyperbolic or conical, have a tulip- or a trumpet-shaped form, etc.

The orifices are punched at right angles to the surface.

The spinning orifices may be arranged as described in, e.g., EP 168 879, but any other type of orifice arrangement is very applicable as well. E.g., the capillaries may be arranged in the form of a circle, in small groups, etc. Hence, there may be portions of the spinning surface without any orifices. Also, the orifices may be present at the centre of the spinning surface while the outer portions do not comprise any orifices at all, or have all orifices situated around the contour of the spinning surface and none at its centre. If a circular spinneret is made, the orifices preferably are arranged in circular lines having a slightly smaller diameter than the outer diameter of the spinneret itself.

Despite the fact that very thin sheet material is employed, a spinneret is obtained which is capable of withstanding the very high pressures that occur during spinning, especially in spinning lyotropic or thermotropic crystalline polymers. Hence, also a spinning process is claimed.

According to such a process, a solution or melt or filament-forming medium is fed to the spinneret under pressure and extruded through the orifices, so forming filaments. It will be evident that the faster the rate of extrusion is and the smaller the orifices are, the greater the pressure exerted on the spinning solution behind the spinneret face must be. Frequently, the pressure will build up to over 10 000 kPa, and also industrial processes are known in which the pressure will build up to over 30 000, 40 000 up to 60 000 kPa and higher. This is the case in particular when highly viscous polymers or polymer solutions are spun, notably when they are spun at high speed.

It has been found that with the spinneret of the present invention these pressures can easily be withstood. In consequence, the spinneret is of particular advantage when viscous polymers or polymer solutions are spun, notably when they are spun at high speed.

Such high pressures are generated in particular when liquid crystalline polymer melts or solutions are spun. As a rule, they are spun from a solution, said solution being high-viscous. Frequently, the viscosity of these solutions is higher than 150 Pa.s (at 293 K (20° C.) in $H_2SO_4$). As examples of such solutions may be mentioned aromatic polyamide, e.g., aramid, more particularly paraphenylene terephthalamide in sulphuric acid, and cellulose, such as disclosed in U.S. Pat. No. 4,839,113.

Thus, the invention further relates to a process for spinning liquid crystalline polymers employing a spinneret having the aforementioned geometry in which the pressure exerted on the spinneret is in excess of 10 000 kPa.

For instance, when a PPDT-sulphuric acid solution of a concentration of 19.34 wt. % and a relative viscosity of 4.5 is spun at a rate of 1000 meters per minute, the pressure at 358 K (85° C.) (spinning temperature) readily amounts to 12 000 kPa.

From an economical standpoint it is advisable to spin at higher rates still. The present spinnerets do not allow for this, since they are subject to deformation under said high pressures. Admittedly, the prior art spinneret's strength may be increased by reducing its surface area, yet the strength that will be attained is still insufficient for processing melt polymers or solution polymers of a high viscosity at a high speed. Moreover, it is economically disadvantageous to reduce the spinnerets surface area.

The now found spinneret is in particular very advantageous in the spinning of regenerated cellulose fibres. The solutions of which such fibres are spun usually show a viscous-elastic, non-Newtonian behaviour, which means that even the slightest uneveness in a spinning orifice results in curling, unevenly shaped fibres which are not applicable for industrial purposes. Due to the very even and homogeneous shape of the orifices in the presently found spinneret, a highly beneficial process for spinning such cellulose fibres becomes available. If high spinning speeds, such as 400 or even 500 meters per minute, are applied in the spinning of solutions of a high viscosity the pressures on the spinneret will mount up very high. These pressures can mount up to 50 000 kPa, 60 000 kPa or even higher. It was found that the spinneret of the present invention does not deform or break at such pressures and, therefore, is in particular advantageous for the spinning process of solutions which are highly viscous and show a viscous-elastic, non-Newtonian behaviour. Such spinnerets have not been available before and, thus such solutions could not be spun at the indicated high speeds before.

The present invention is further illustrated by the examples below. Percentages indicated are weight percentages, unless indicated otherwise.

Material A

A noble metal alloy obtained from Degussa consisting of 69.5% Au, 30% Pt, and 0.5% Rh was heated for 30 minutes at 1423 K (1150° C.), rapidly cooled in water containing 5% of NaCl, and hardened for 6 hours at 823 K (550° C.). A test strip of this material was prepared and used to determine the physical properties of the material, which are indicated in Table I below under A. Microscopic analysis of the material showed that the metal alloy had a coarse structure, with the size of the metal grains being in the range of 10–40 μm, the major portion of the grains being in the range of 25–40 μm. More than 0.05 wt. % of contaminations such as copper and iron were found to be present in the material. Clearly, islands of Pt rich and areas of Pt poor material were seen at the EDX carried out as described in the specification.

Material B

A noble metal alloy of the same composition as indicated under Material A but containing almost no impurities, so that a material was obtained from which a very pure and homogeneous structure could be made.

The material was heated for 30 minutes at 1423 K (1150° C.), rapidly cooled in water containing 5% of NaCl, and hardened for 3 hours at 823 K (550° C.). A test strip as indicated below was prepared from this material for testing purposes. The physical properties of the material are indicated in Table I under B. Less than 0.012 wt. % of contaminations were found to be present in the material. The size of the metal grains was in the range of 10–20 μm without large grains being present, and no second phase was found in the EDX of the material.

Material C

A noble metal alloy consisting of 59% Au, 30% Pt, 10% Pd, and 1% Rh was heated for 30 minutes at 1343 K (1070° C.), rapidly cooled in water containing 5% of NaCl, and hardened for 3 hours at 873 K. A test strip as indicated below was prepared from this material for testing purposes. The physical properties of the material are indicated in Table I under C. The size of the metal grains was in the range of 10–20 μm without large grains being present. Less than 0.012 wt. % of impurities were found. On EDX, no second phase was found.

Figure 3:
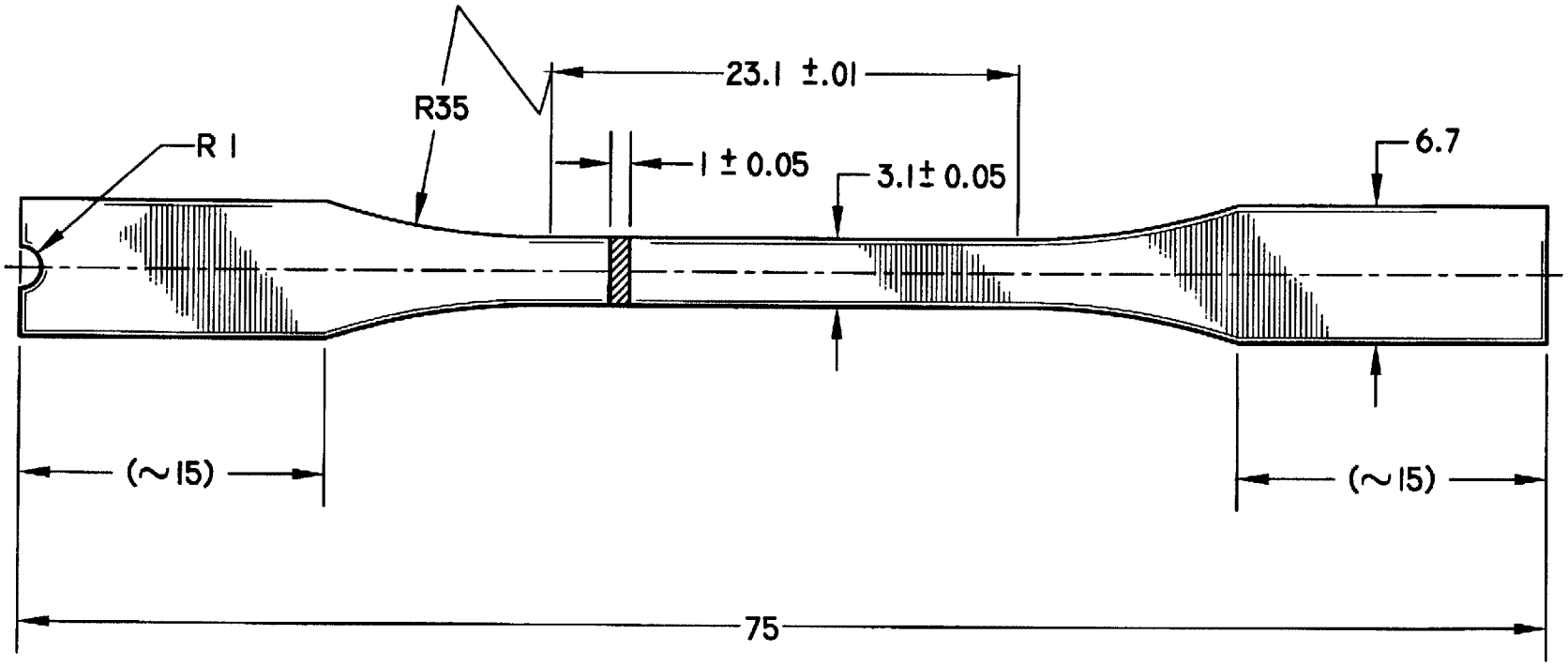
FIG. 3 is a schematic of a test strip used to measure the tensile strength of the spinneret material.

The tensile strength was determined by testing the material strip on a draw-bench (Zwick). The drawing speed was 3 mm/min., the size of the test strip is indicated in FIG. 3. From this measurement the tensile strength, the yield strength at 0.2% deformation, and the modulus of elasticity were found.

The hardness was measured with a Vickers hardness tester.

The following results were found

TABLE I

| Material | A | B | C |
|---|---|---|---|
| Hardness [HV 0, 1] | 210 | 250 | 310 |
| Tensile strength [N/mm$^2$] | 650 | 830 | 1020 |
| Yield strength 0, 2 [N/mm$^2$] | 500 | 670 | 850 |
| Modulus of elasticity [N/mm$^2$] | 100 000–110 000 | 110 000–120 000 | 140 000–150 000 |

From the materials indicated above, four different types of spinnerets were made by making the desired metal alloy, cold rolling the material to the desired thickness of the plate (for the spinnerets indicated below, 0.6, 0.8, and 1.0 mm, respectively), heating the plate (materials A and B for 30 minutes at 1423 K (1150° C.), material C for 30 minutes at 1343 K (1070° C.)), rapidly cooling the plate in water containing 5% of NaCl, shaping the so obtained plate by deep drawing to the desired spinneret shape in a manner known in itself, punching the spinning orifices, preferably by use of a sapphire material needle, and heat treating the so obtained spinneret (materials A and B for 6 hours at 823 K (550° C.) and material C for 3 hours at 873 K (600° C.)).

In a separate procedure, it was found that the general behaviour of the spinneret was not influenced by the presence of any orifices. Therefore, the influence of the spinning orifices on the strengths found was not taken into account in the examples.

The following types of spinnerets were used:

Spinneret type 1

Spinneret type 1 has the shape indicated in FIG. 1. The places were the spinneret is gripped between the jaws are indicated. The radius of the spinning surface was 11 mm (the shortest distance between the gripping edges thus being 22 mm), the radius of the curvature was 22 mm. The diameter of the spinneret was 31 mm.

Spinneret type 2

Spinneret type 2 has the shape indicated in FIG. 2. The radius of the spinning surface between the jaws was 11 mm, the radius of the curvature was 22 mm. The diameter of the spinneret was 31 mm.

Spinneret type 3

Spinneret type 3 has a raised edge adjacent to the spinning surface, the gripping edge is adjacent to the raised edge and is in the horizontal surface. The radius of the spinning surface was 11 mm, the shortest distance between the gripping edges was 22 mm, the spinning surface was bulged, the curvature having a radius of 22 mm. The diameter of the spinneret was 31 mm.

Spinneret type 4

Spinneret type 4 has a geometry as indicated in FIG. 1, except that the raised edge is not present. The places where the spinneret is gripped between the jaws are indicated. The radius of the spinning surface was 11 mm (the smallest distance between the gripping edges thus being 22 mm), the radius of the curvature was 30.5 mm. The diameter of the spinnenet (including the gripping edges) was 28 mm.

Spinneret type 5

Spinneret type 5 is a so-called ringspinnerette with a raised edge adjacent to the ring-shaped spinning surface. The inner diameter of the spinning surface was 27 mm, the outer diameter 57 mm. The gripping edge is adjacent to the outer raised edge. The spinning surface was flat, the diameter of the spinneret was 70 mm.

Spinneret type 6

Spinneret type 6 has a geometry similar to spinneret type 5, except that the spinning surface was bulged, the curvature having a radius of 25 mm.

Two types of experiments were performed:

The maximum pressure at which the spinneret can be operated without more than 0.2% deformation of the spinning surface (D 0.2%) was calculated by means of a structural analysis type program "Algor Nonlinear Static Analysis" (APAKO), version 5.096-3H. For all calculations, the cumulated tension was determined, i.e. the van Mises tension.

This particular pressure was chosen since a further deformation is no longer useful for the production of homogeneous, evenly shaped fibres.

Examples I–IV relate to these type of experiments. The results of these experiments are given in Table II.

Spinnerets were pressurised in an appropriate housing using water at 20° C. The deformation of the spinneret was measured in the centre of the spinning surface. The pressure on the spinneret was gradually increased. After each pressure increment the deformation was measured.

In particular the deformation at a load of 60000 kPa (D600) and the load at fracture (LaF) of the spinnerets were determined.

Examples V–IX relate to these type of experiments. The results of these experiments are given in Table III.

TABLE II

| Example | Spinneret type | Material | Sheet thickness [mm] | D 0, 2% [kpa] |
|---|---|---|---|---|
| I-a | 1 | A | 0.6 | 20100 |
| I-b | 1 | B | 0.6 | 32500 |
| I-c | 1 | C | 0.6 | 36500 |
| I-d | 1 | A | 0.8 | 27500 |
| I-e | 1 | B | 0.8 | 45500 |
| I-f | 1 | C | 0.8 | 49500 |
| I-g | 1 | A | 1.0 | 34500 |
| I-h | 1 | B | 1.0 | 55500 |
| I-i | 1 | C | 1.0 | 62000 |
| II-a | 2 | A | 0.6 | 22200 |

TABLE II-continued

| Example | Spinneret type | Material | Sheet thickness [mm] | D 0, 2% [kpa] |
|---|---|---|---|---|
| II-b | 2 | B | 0.6 | 37000 |
| II-c | 2 | C | 0.6 | 41000 |
| II-d | 2 | A | 0.8 | 29000 |
| II-e | 2 | B | 0.8 | 48000 |
| II-f | 2 | C | 0.8 | 53500 |
| II-g | 2 | A | 1.0 | 35000 |
| II-h | 2 | B | 1.0 | 58500 |
| II-i | 2 | C | 1.0 | 65000 |
| III-a* | 3 | A | 0.6 | 18200 |
| III-b | 3 | B | 0.6 | 29600 |
| III-c | 3 | C | 0.6 | 33300 |
| III-d* | 3 | A | 0.8 | 25000 |
| III-e | 3 | B | 0.8 | 42000 |
| III-f | 3 | C | 0.8 | 46500 |
| III-g* | 3 | A | 1.0 | 31000 |
| III-h | 3 | B | 1.0 | 50500 |
| III-i | 3 | C | 1.0 | 57500 |
| IV-a* | 4 | A | 0.6 | 11400 |
| IV-b | 4 | B | 0.6 | 19500 |
| IV-c | 4 | C | 0.6 | 21500 |
| IV-d* | 4 | A | 0.8 | 14900 |
| IV-e | 4 | B | 0.8 | 25500 |
| IV-f | 4 | C | 0.8 | 28000 |
| IV-g* | 4 | A | 1.0 | 16900 |
| IV-h | 4 | B | 1.0 | 29000 |
| IV-i | 4 | C | 1.0 | 32000 |

Examples III-a, III-d, II-g, IV-a, IV-d, and IV-g, having neither the geometry nor the material according to the invention, are comparative examples.

Examples III and IV show that even when using a known geometry a significant improvement of the pressure resistance can be obtained if the spinneret consists of the material according to the invention.

TABLE III

| Example | Spinneret type | Material | Sheet thickness [mm] | D600 [mm] | LaF [kpa] |
|---|---|---|---|---|---|
| V-a | 1 | A | 1.0 | 0.51 | 85000 |
| V-b | 1 | B | 1.0 | 0.44 | 88000 |
| V-c | 1 | C | 1.0 | 0.18 | 105000 |
| V-d | 1 | C | 0.8 | — | 70000 |
| VI | 2 | C | 1.0 | 0.33 | 130000 |
| VII | 4 | C | 1.0 | 1.33 | 95000 |
| VIII-a* | 5 | A | 0.8 | — | 26000 |
| VIII-b | 5 | C | 0.8 | — | 32000 |
| IX | 6 | C | 0.6 | — | 26000 |

Example VIII-a having neither the geometry nor the material according to the invention, is a comparative example.

We claim:

1. A spinneret of a gold and platinum-containing metal alloy, in which the face provided with spinning orifices is convex, the spinneret being provided with a raised edge and an edge where the spinneret is gripped in the spinning assembly, characterised in that the gripping edge is immediately adjacent to the face provided with spinning orifices.

2. A spinneret according to claim 1, characterised in that the thickness of the spinneret is in the range of 0.3 to 1.75 mm.

3. A spinneret according to claim 2, characterised in that there is no curve between the gripping edge and the spinning surface.

4. A spinneret according to claim 1, characterised in that the spinneret comprises at least 100 spinning orifices.

5. A spinneret according to claim 1, characterised in that the spinneret is made of a noble metal alloy comprising gold, platinum, rhodium, and palladium.

6. A spinneret according to claim 5, characterised in that the noble metal alloy consists of gold, platinum, rhodium, and palladium in a weight ratio ranging between 50–65:20–40:0–8:5–15.

7. A spinneret according to claim 6, characterised in that the noble metal alloy consists of gold, platinum, rhodium, and palladium in a weight ratio ranging between 58–61:28–32:0–2:8–12.

8. A spinneret according to any one of claims 1–7, characterised in that the spinneret is made of a noble metal alloy material which has a fine homogeneous structure in which no obvious second phase is present.

9. A spinneret of a gold and platinum-containing metal alloy, the spinneret being provided with a convex spinning face and an edge where the spinneret is gripped in the spinning assembly, characterised in that the spinneret is made of a noble metal alloy material which has a fine homogeneous structure in which no obvious second phase is present.

10. A spinneret according to claim 9, characterised in that the spinneret is made of a noble metal alloy which has a grain size less than 25 μm.

11. A spinneret according to claim 10, characterised in that the grain size is less than 20 μm.

12. A spinneret according to any one of claims 9–11, characterised in that the spinneret is made of a noble metal alloy in which less than 0.02 wt. % of contaminants are present.

13. A spinneret according to any one of claims 9–11, characterised in that the spinneret is made of a noble metal alloy comprising gold, platinum, rhodium, and palladium.

14. A spinneret according to claim 13, characterized in that the spinneret is made of a noble metal alloy comprising gold, platinum, rhodium, and palladium in a weight ratio ranging between 50–65:20–40:0–8:5–15.

15. A process for spinning a liquid-crystalline polymer solution or melt, in which process the solution, or melt is extruded through a spinneret and wherein the pressure exerted on the spinneret exceeds 10000 kPa, characterised in that a spinneret according to claim 1 is employed.

16. A process according to claim 15, characterised in that a liquid-crystalline polymer solution is spun.

17. A process according to claim 16, characterised in that the solution contains an aromatic polyamide.

18. A process according to claim 17, characterised in that the solution contains polyparaphenylene terephthalamide.

19. A process according to claim 16, characterised in that the solution is obtained by dissolution of cellulose.

20. A process according to any one of claims 16–19, characterised in that the pressure exerted on the spinneret exceeds 40 000 kPa.

21. A process according to claim 20, characterised in that the pressure exerted on the spinneret exceeds 50 000 kPa.

22. A spinneret of a Sold and platinum-containing metal alloy, the spinneret being provided with a convex spinning face and an edge where the spinneret is gripped in the spinning assembly, characterised in that the spinneret is made of a noble metal alloy material which has a fine homogeneous structure in which no obvious second phase is present and which has a grain size less than 25 μm.

23. A spinneret according to claim 8, characterised in that the spinneret is made of a noble metal alloy in which less than 0.02 wt % of contaminates are present.

24. A spinneret according to claim 12, characterised in that the spinneret is made of a noble metal alloy comprising gold, platinum, rhodium, and palladium.

25. A spinneret according to claim 8, chracterised in that the spinneret is made of a noble metal alloy which has a grain size less than 25 μm.

* * * * *